US005791608A

United States Patent [19]

Nielsen et al.

[11] Patent Number: 5,791,608

[45] Date of Patent: Aug. 11, 1998

[54] MAGNETIZED BRUSH AND TOOL RETAINER

[76] Inventors: Wade S. Nielsen; Marjorie M. Nielsen, both of 2214 1/2 North Ave., Chico, Calif. 95926

[21] Appl. No.: 791,250

[22] Filed: Jan. 30, 1997

[51] Int. Cl.[6] ..... B65D 75/14

[52] U.S. Cl. ..... 248/110; 206/362.4; 248/206.5

[58] Field of Search ..... 206/362.4, 361, 206/15.3; 248/206.5, 205.2, 213.2, 110

[56] References Cited

U.S. PATENT DOCUMENTS

| | | | |
|---|---|---|---|
| 4,606,456 | 8/1986 | Kaminski | 206/362.4 |
| 4,660,715 | 4/1987 | Anastos | 248/206.5 X |
| 4,736,853 | 4/1988 | O'Mara | 248/206.5 X |
| 5,174,445 | 12/1992 | Mull . | |
| 5,465,453 | 11/1995 | Landmeier | 206/362.4 X |

FOREIGN PATENT DOCUMENTS

| | | | |
|---|---|---|---|
| 267356 | 3/1927 | United Kingdom | 206/361 |

*Primary Examiner*—James R. Brittain
*Attorney, Agent, or Firm*—Larry D. Johnson

[57] ABSTRACT

A holder or wrapper apparatus for paint brushes and other small tools is preferably made of a flexible, porous (breathable) material such as canvas or fabric, and may include a plurality of folding panels or flaps that fold over and fasten upon one another with hook and loop fastener portions. The retainer apparatus also includes a magnetic patch or insert that is itself covered with fabric or like material to prevent damage to metal finishes.

1 Claim, 5 Drawing Sheets

MAGNETIZED BRUSH AND TOOL RETAINER

BACKGROUND OF THE INVENTION

1. Field of the Invention

This invention relates generally to paint brushes, tools, and associated hardware, and more specifically to an improved retainer device for use with paint brushes and small tools.

2. Description of the Prior Art

Paint brushes are preferably kept in a wrapper or holder both before and after use to retain the form of the brush, and to protect the brush bristles from damage. However, most known paint brush holders are inefficient, awkward to use, and/or relatively expensive.

SUMMARY OF THE INVENTION

The magnetized brush and tool retainer of this invention provides a holder or wrapper apparatus for paint brushes and other small tools. The retainer apparatus is preferably made of a flexible, porous (breathable) material such as canvas or fabric, and may include a plurality of folding panels or flaps that fasten upon one another with hook and loop fastener portions. The retainer apparatus also includes a magnetic patch or insert that is itself covered with fabric or like material to prevent damage to metal finishes.

The inventive apparatus will thus hold a paint brush to its shape, as well as allowing the brush to dry rapidly through the porous covering after being cleaned. The apparatus allows the user to store brushes by attaching them vertically or horizontally on most metal surfaces, such as pick-up truck side walls, van side walls and ceilings, metal shop siding, and metal tool box lids and sides. In addition, brushes can be arranged on the inside or outside of metal paint buckets and pails.

These brush "keepers" will outlast traditional paper covers by many years. When the brush cover is empty it can be stored safely and securely against its metal storage place preventing loss, misplacement or damage. Covers can be easily monogrammed with a company logo, or hand labeled to indicate the type of brush or usage intent for specialized materials. The size and shape of the brush is instantly recognizable without opening the cover. The cover can be hand rinsed out periodically with soap and water. Solvents such as paint thinner, lacquer thinner and turpentine will not deteriorate the fabric. The covers may also be used to store and protect many types of hand tools in the same manner as described herein.

Typical directions for use of the paint brush holder embodiment of the apparatus may include the following:

1. Hold the keeper upright in your right hand by the top flap, printed side facing away, with all flaps open. Place the handle of the proper paint brush for the particular keeper into the lower flap hole until it stops, making sure to keep the brush straight. The magnets should hold the brush in place (by attraction to the metal part of the brush handle) while making these adjustments.

2. When the brush is properly aligned, you should be holding the brush and keeper at the ferrule with your right hand. With your left hand, gently pull the left flap snugly closed over the brush and hold the flap down with your right thumb. With your left hand, grasp the brush and keeper at the ferrule. While holding the brush in this position, use your right hand to pull the right flap snugly closed over the brush, pressing the Velcro firmly together.

3. Firmly holding the brush and keeper in an upright position with your right hand, lift the bottom flap up into position and hold firmly together with your left hand. With your right hand, pull the top flap down and closed by pressing the Velcro firmly together.

4. After the brush is properly placed in the keeper, hold the brush and keeper firmly in your right palm in an upright position, then with your left hand gently pull down on the handle. This step will keep the bristle tips in their proper position.

An alternate embodiment of the invention provides flexible, solvent proof, magnetic strips fitted with powerful magnet inserts that are covered with fabric for metal finish protection, and can be used for holding various metal objects. These "holders" can be hand labeled to indicate the type or intended usage for specialized materials. The holders can be rinsed out periodically and allowed to air dry by simply hanging them from their magnets.

Mechanics may use these holders to hold large and small parts to the side of solvent tubs while cleaning, as well as allowing them to dry rapidly after being cleaned.

The holders can be attached to a vehicle's motor compartment, fender or undercarriage to hold hand tools within reach, as well as those easy to lose items such as nuts and bolts.

Attached to the front or side of a metal machine (such as a sewing machine), the holder allows the operator to keep scissors, instruments, bobbins, gauges and other hand tools within reach while keeping their work space clear.

The device allows mobile repair services to store their most used tools and parts on accessible surfaces, such as pick-up side walls, van side walls and ceilings, metal tool box lids and sides, refrigerators, and washer and dryers without scratching or marring surfaces.

DETAILED DESCRIPTION OF A PREFERRED EMBODIMENT

Figure 1:
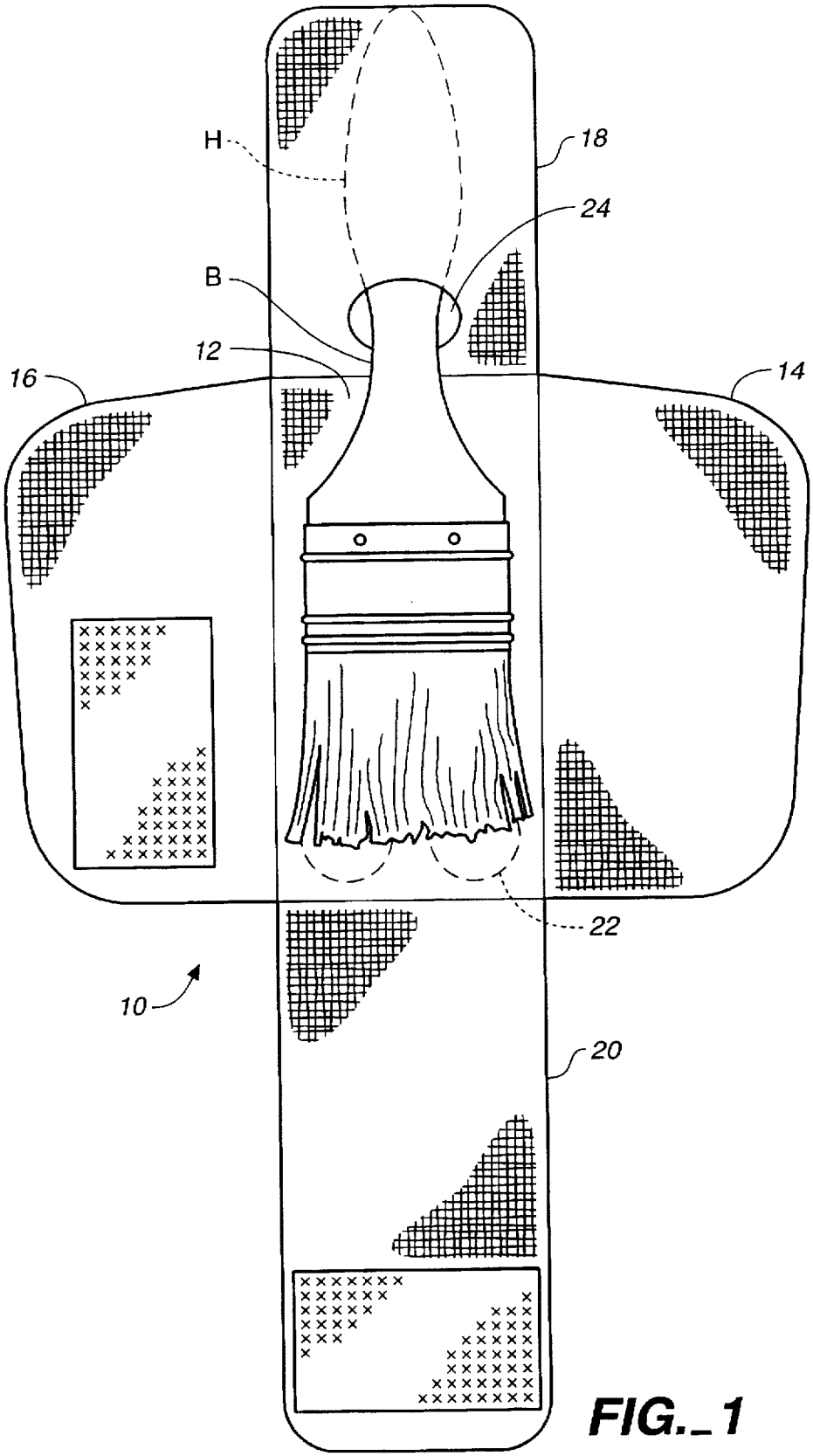
FIG. 1 is a plan view of a magnetized brush retainer of this invention, illustrating its plurality of panels with hook and loop fastener portions, about a central panel bearing a magnetic patch or insert portion.

FIG. 1 is a plan view of a magnetized brush retainer body 10 illustrating its plurality of porous fabric panels including central panel 12, first lateral panel 14, second lateral panel 16, brush handle receiving panel 18, and front panel 20. Central panel 12 includes a magnetic patch or insert portion 22 so that the retainer may be releasably affixed to a metallic surface, as described herein. Magnetic patch 22 is preferably made by enclosing a plurality of small magnets within a pocket or sleeve of the fabric material. Brush B is placed into the retainer 10 so that its handle H extends through receiving aperture 24 in brush handle receiving panel 18.

Figure 2:
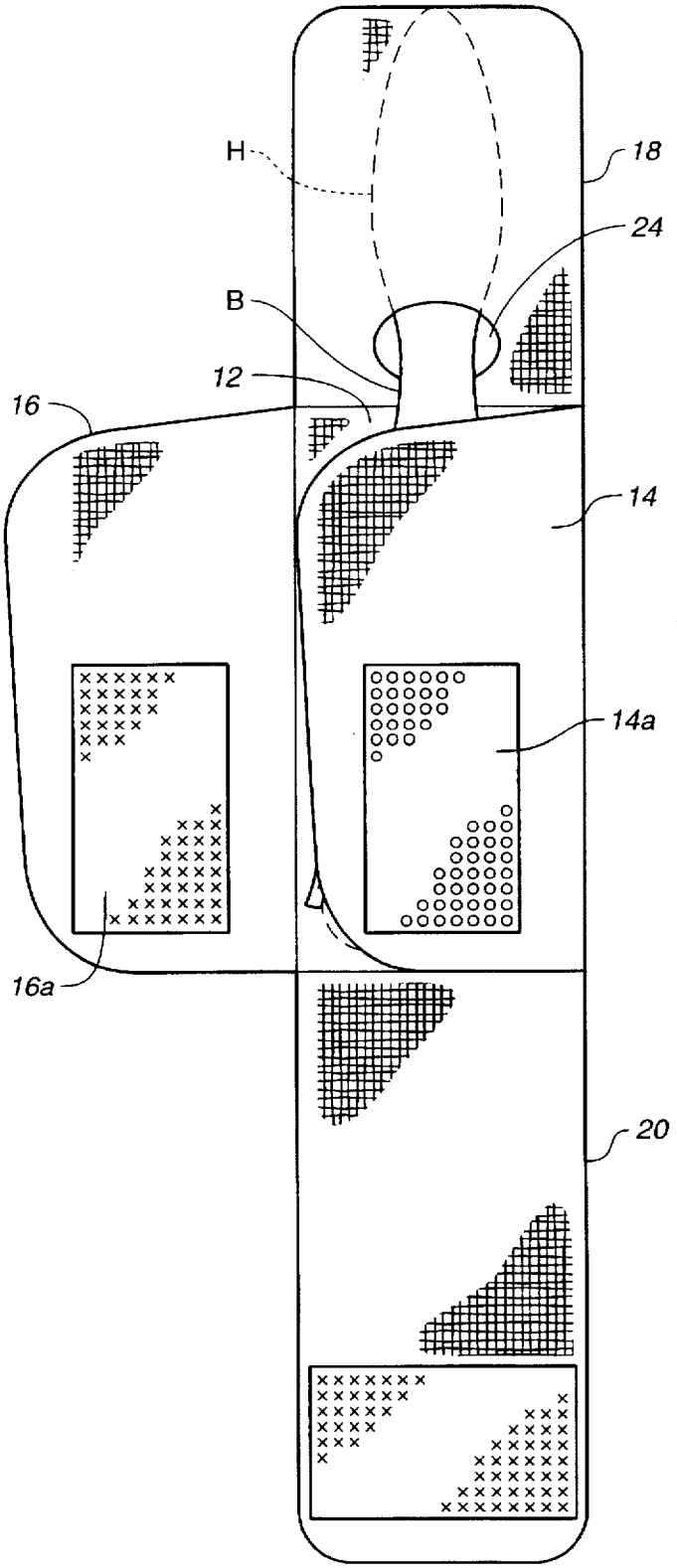
FIG. 2 is a plan view of the magnetized brush retainer of FIG. 1 illustrating the first lateral panel having been folded over the central panel and brush.

FIG. 2 is a plan view of the magnetized brush retainer of FIG. 1 illustrating first lateral panel 14 having been folded over the central panel 12 and brush B. First lateral panel 14 includes a portion of hook and loop fastener material 14*a* that is complementary to a like sized portion of hook and loop fastener 16*a* on second lateral panel 16.

Figure 3:
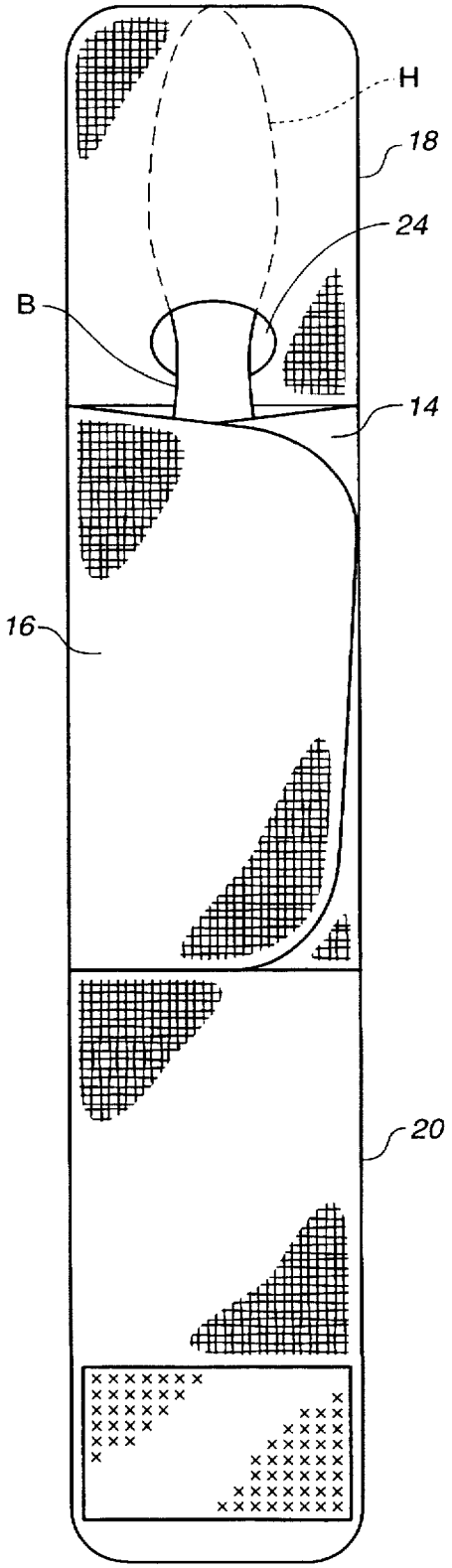
FIG. 3 is a plan view of the magnetized brush retainer of FIG. 2 illustrating the second lateral panel having been folded over the first lateral panel so that their complementary portions of hook and loop fastener are engaged.

FIG. 3 is a plan view of the magnetized brush retainer of FIG. 2 illustrating second lateral panel 16 having been folded over first lateral panel 14 so that their complementary portions of hook and loop fastener are engaged.

Figure 4:
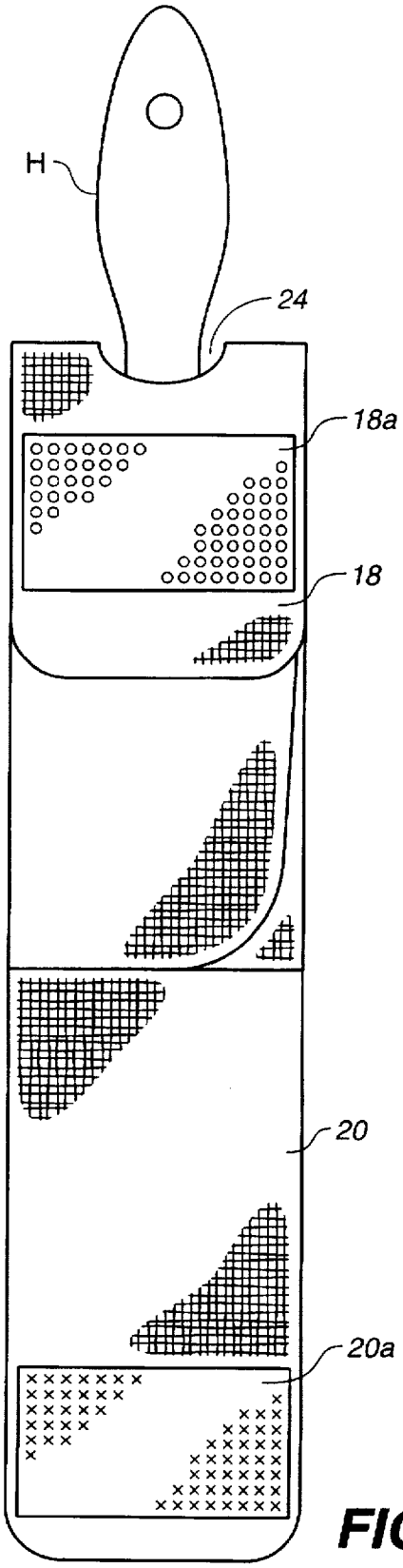
FIG. 4 is a plan view of the magnetized brush retainer of FIG. 3 illustrating the brush handle receiving panel having been folded over the joined lateral panels, with the paint brush handle extending through the brush handle receiving aperture thereof.

FIG. 4 is a plan view of the magnetized brush retainer of FIG. 3 illustrating brush handle receiving panel 18 having been folded over the joined lateral panels below, with brush handle H extending through the receiving aperture 24. Brush handle receiving panel 18 includes a patch of hook and loop fastener material 18*a* that is complementary to a like sized patch of hook and loop fastener 20*a* located on front panel 20.

Figure 5:
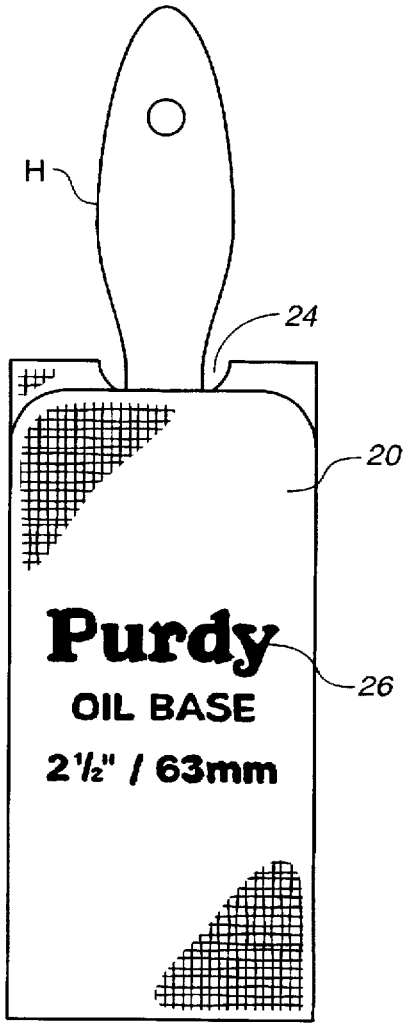
FIG. 5 is a plan view of the magnetized brush retainer of FIG. 4 illustrating the front panel having been folded over the brush handle receiving panel so that their complementary portions of hook and loop fastener are engaged.

FIG. 5 is a plan view of the magnetized brush retainer of FIG. 4 illustrating the front panel 20 having been folded over the brush handle receiving panel 18 so that their complementary portions of hook and loop fastener are engaged. Front panel 20 may bear indicia 26 for informational or advertising purposes. This view further illustrates how the canvas or other flexible, porous material making up the brush retainer is able to generally contour to the shape of the brush within, and may be adjustable to fit a range of similar sizes and shapes.

Figure 6:
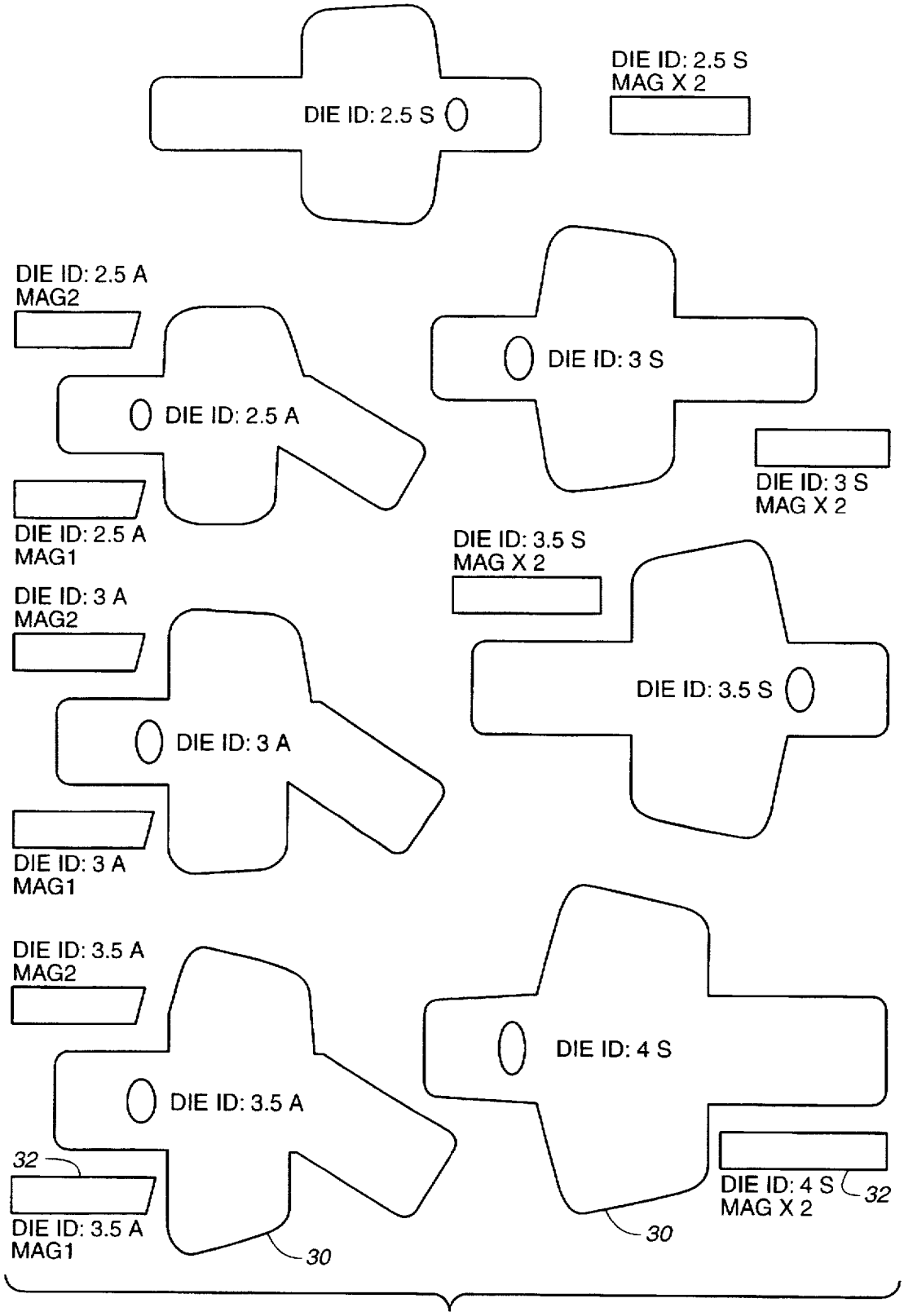
FIG. 6 is a plan view of variously-sized dies or outlines for manufacturing brush retainers for straight and angled brushes, including their associated magnet pockets.

FIG. 6 is a plan view of variously-sized dies or outlines 30 that may be used for manufacturing the brush retainers of this invention. This view also illustrates variously-sized dies or outlines 32 for manufacturing the magnet pockets associated with the respective brush retainers.

Figure 7:
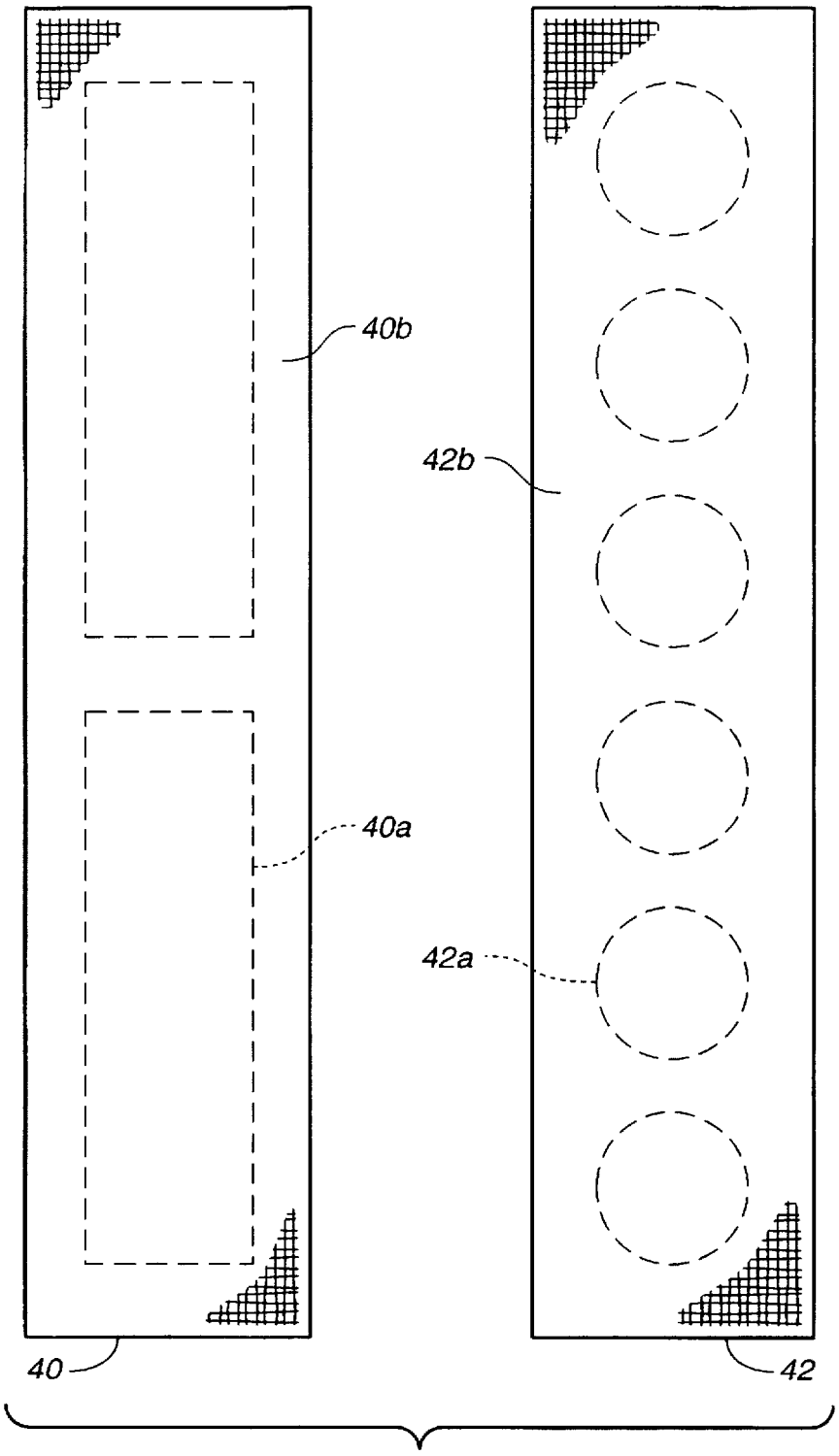
FIG. 7 is a plan view of a pair of magnetic holder devices of this invention, illustrating alternate magnetic inserts in phantom.

FIG. 7 is a plan view of a pair of magnetic holder devices 40, 42. These holder devices consist of a magnetic insert 40*a*, 42*a* within a sleeve or envelope 40*b*, 42*b* of flexible, porous material.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims and equivalents.

What is claimed as invention is:

1. A retainer apparatus for storing a brush, said brush having a bristle portion and a handle portion, said retainer apparatus comprising:

a body of flexible, porous material, said body having a plurality of panel portions including a central panel, first lateral panel, second lateral panel, brush handle receiving panel, and front panel;

said central panel including a magnetic insert portion enabling releasable affixation to a metallic surface;

said brush handle receiving panel including an aperture enabling a brush handle to extend therethrough;

said first lateral panel and second lateral panel each bearing complementary portions of hook and loop fastener material enabling releasable engagement of said first lateral panel to said second lateral panel; and said brush handle receiving panel and said front panel each bearing complementary portions of hook and loop fastener enabling releasable engagement of said brush handle receiving panel to said front panel, wherein when a brush is placed in said retainer apparatus so that the brush bristle portion is adjacent said central panel and the brush handle portion extends through said brush handle receiving panel aperture, said first lateral portion and second lateral portion may be folded over and engaged together over the brush bristle portion, and said brush handle receiving panel and said front panel may be folded over and engaged together over the engaged first lateral portion and second lateral portion, thereby retaining said brush bristle portion within.

* * * * *